US011111039B2

(12) United States Patent
Yang

(10) Patent No.: US 11,111,039 B2
(45) Date of Patent: Sep. 7, 2021

(54) STRUCTURE FOR PREVENTING FORMATION OF DEAD POINT FOR CAM WHEEL AND STRAPPING DEVICE USING THE SAME

(71) Applicant: PANTECH INTERNATIONAL INC., New Taipei (TW)

(72) Inventor: Ming Shih Yang, New Taipei (TW)

(73) Assignee: PANTECH INTERNATIONAL INC., New Taipei (TW)

( * ) Notice: Subject to any disclaimer, the term of this patent is extended or adjusted under 35 U.S.C. 154(b) by 405 days.

(21) Appl. No.: 16/244,948

(22) Filed: Jan. 10, 2019

(65) Prior Publication Data

US 2020/0223572 A1 Jul. 16, 2020

(51) Int. Cl.
*B65B 13/22* (2006.01)
*B65B 13/02* (2006.01)
*B65B 13/18* (2006.01)

(52) U.S. Cl.
CPC ..... *B65B 13/22* (2013.01); *B65B 13/025* (2013.01); *B65B 13/185* (2013.01)

(58) Field of Classification Search
CPC ..... B65B 13/025; B65B 13/18; B65B 13/185; B65B 13/22; B65B 13/30; B65B 13/305; B65B 13/322; B65B 13/327; B65B 65/02; F16H 25/14; F16H 25/16; F16H 21/50; F16H 21/52; F16H 21/54
See application file for complete search history.

(56) References Cited

U.S. PATENT DOCUMENTS

| | | | | |
|---|---|---|---|---|
| 1,822,163 | A * | 9/1931 | McGrath | F02N 15/063 74/7 R |
| 9,683,642 | B2 * | 6/2017 | Tomkinson | F16H 25/186 |
| 2011/0056398 | A1 | 3/2011 | Weiss et al. | |
| 2016/0046398 | A1 * | 2/2016 | Neeser | B65B 13/187 100/2 |
| 2017/0100836 | A1 * | 4/2017 | Dellon | F16H 25/125 |

* cited by examiner

*Primary Examiner* — Shelley M Self
*Assistant Examiner* — Katie L. Parr
(74) *Attorney, Agent, or Firm* — Muncy, Geissler, Olds & Lowe, P.C.

(57) ABSTRACT

A structure for preventing the formation of a dead point for a cam wheel includes a driving wheel with a pressing portion provided at one side thereof for pushing a pushed portion of the cam wheel. When the cam wheel is moved over a distance while rotating simultaneously, a cam portion of the cam wheel pushes one end of the swinging piece. When the one end of the swinging piece is pushed to be apart from the outer periphery of the cam wheel, a restoring piece axially pushes the cam wheel back to its original position. A strapping device includes the above structure, a housing, a first transmission assembly, a second transmission assembly and a third transmission assembly. Tensioning of a circular strap, rapid friction bonding and cutting are sequentially performed by the transmissions of the first to third assemblies, respectively.

8 Claims, 9 Drawing Sheets

STRUCTURE FOR PREVENTING FORMATION OF DEAD POINT FOR CAM WHEEL AND STRAPPING DEVICE USING THE SAME

FIELD OF THE INVENTION

The present invention relates to a structure for preventing the formation of a dead point for a cam wheel and a strapping device using the same and, more specifically, a structure and a strapping device that improve work efficiency by preventing unexpected dead points from forming during the strapping operation.

BACKGROUND OF THE INVENTION

A common handheld strapping device essentially involves tensioning of a plastic strap with a feeder wheel and subsequent sealing and cutting of an overlapped area of the two ends of the plastic strap for quick and effective wrapping of packaged goods. More specifically, after placing the overlapped strap in a tensioning zone, the feeder wheel is rotated upon the actuation of a start-up button to allow the tensioning of the relaxed strap. Once the strap is tensioned, the sealing of the overlapped layers of the strap can take place by ways of lateral reciprocating movements of a sealing head, which is activated by pressing a sealing button. An unwanted portion of the strap is then cut off and the strap is released from the device by moving the feeder wheel upwards through manually lifting of a lever. In the meantime, the sealing button is returned to its original position, which completes the current strapping process and the device is ready for another strapping procedure.

Typically, one end of an arm is pushed via a cam wheel, such that the other end of the arm is positioned before the above sealing and cutting steps are carried out, regardless of whether in a manual or semi-automatic device. After the strapping is completed, the arm must be returned to the original position by lifting a lever. U.S. Patent Application Publication No. 2011/0056389 A1, entitled "STRAPPING DEVICE WITH A GEAR SYSTEM DEVICE", discloses a fully automatic strapping device. As described, during the sealing step, as shown in FIG. 7 of the publication, a cam wheel 33 is rotated anti-clockwise, such that a cam 32 comes into contact with a contact element 64, which is forced to rotate in a clockwise direction around a pivoting axis 62. In FIG. 9 of the same publication, when the contact element 64 is pushed to its highest point, in which a connecting line 68 is higher than the pivoting axis 62, a welding shoe arm 56 is brought into a position by a compression spring 67 ready for welding.

However, if the cam 32 is terminated at a position such that the ramped portion is right underneath the contact element with the imaginary connecting line intersecting the pivoting axis 62, a dead point will be formed, which holds the device in a state as shown in FIG. 9, preventing it from returning to the state shown in FIG. 7 for a next strapping procedure. To address the problem of dead points, a solution is proposed in US Patent Publication No. 2011/0056389A1 by calculating the cam position from the gear system and controlling this position to prevent it from landing at the dead position.

SUMMARY OF THE INVENTION

However, US Patent Publication No. 2011/0056389 A1 fails to provide actual implementable measures for dealing with the problem. Indeed, in practice, no implementable solutions have yet been proposed. The problem of a dead point can only be overcome after it is formed by pushing the cam wheel with a tool to allow the lever to be pulled up manually to raise the feeder wheel up in preparation for the next strapping procedure. But during the operations, the occurrences of these dead points would interrupt the rhythm and work flow of the engineers, lowering work efficiency. In view of this, the inventor through years of continued research and improvements in the field has finally come up with the present invention to overcome the shortcomings of the prior art.

The main objectives of the present invention is to provide a structure for preventing the formation of a dead point for a cam wheel and a strapping device using the same capable of improving work efficiency by preventing the generations of unexpected dead points from interrupting the work flow.

In order to achieve the above and other objectives, the structure for preventing the formation of a dead point for a cam wheel provided by the present invention may include a driving wheel, a cam wheel, a swinging piece and a restoring piece. The driving wheel is provided with a pressing portion arranged to be coaxial with the driving wheel at one side thereof. The cam wheel is pivoted on the driving wheel in a way of being axially movable with respect to the driving wheel. The cam wheel may include a cam portion and a pushed portion around the same axis. The pushed portion is pushed by the pressing portion when the driving wheel rotates, such that the cam wheel is moved axially in a direction away from one side of the driving wheel. One end of the swinging piece abuts against the outer periphery of the cam wheel by force from a mechanism, such that the one end of the swinging piece is pushed by the cam portion when the cam wheel axially moves and rotates. The restoring piece is connected with the cam wheel for axially pushing the cam wheel back to its original position when the one end of the swinging piece is moved to be apart from the outer periphery of the cam wheel.

In an implementation, the pressing portion may include a plurality of thorn teeth arranged in a form of circular array on the one side of the driving wheel with their teeth surfaces facing the cam wheel, and the pushed portion may be a plurality of thorn teeth with their teeth surfaces facing and engaging the pressing portion.

In an implementation, the pressing portion may be a rod, and the pushed portion may be a guiding slot formed on the cam wheel and arranged radially for the rod to be inserted and limited therein.

In an implementation, the cam wheel may include a circumferential surface, an ascending portion and a ramp portion. The circumferential surface has an equal radius. The ascending portion has a thickness less than that of the circumferential surface for pushing the one end of the swinging piece. The ramp portion has gradually increasing radii for guiding the one end of the swinging piece from the circumferential surface onto the ascending portion of the cam wheel.

In an implementation, the restoring piece may be a compression spring, and one end of the cam portion may be provided with a positioning portion for positioning the compression spring.

In an implementation, the present invention may further include a stopping piece pivoted on the driving wheel and the cam wheel for stopping the cam wheel so as to limit the axial movements of the cam wheel.

The strapping device of the present invention may include the a structure for preventing the formation of a dead point for a cam wheel as describe above, a housing, a first transmission assembly, a second transmission assembly and a third transmission assembly. The first transmission assembly is received in the housing and connected to a feeder wheel. The first transmission assembly is driven by an electric drive to rotate the feeder wheel to tension a circular strap. The second transmission assembly is connected with the driving wheel. The second transmission assembly is driven by the electric drive to rotate the driving wheel to push the one end of the swinging piece. The third transmission assembly may include a pressing piece, a crankshaft-connection-rod set and an actuator. The pressing piece is sheathed inside an elastic piece. A sealing head and a cutter are provided at the bottom of the pressing piece and connected with the crankshaft-connection-rod set, such that the crankshaft-connection-rod set is driven by the electric drive to reciprocate the sealing head laterally to perform rapid friction bonding of an overlapped portion of the circular strap, and the excess portion of the circular strap is cut off by the cutter. The swinging piece is a rocker arm, two ends of which swing in opposite directions. The actuator is connected to the one end of the rocker arm and provided with a positioning portion for positioning one end of the pressing piece.

The foregoing features and advantages of the present invention will become more apparent from the following detailed description taken in conjunction with the accompanying drawings.

DETAILED DESCRIPTION OF THE EMBODIMENTS

Figure 1:
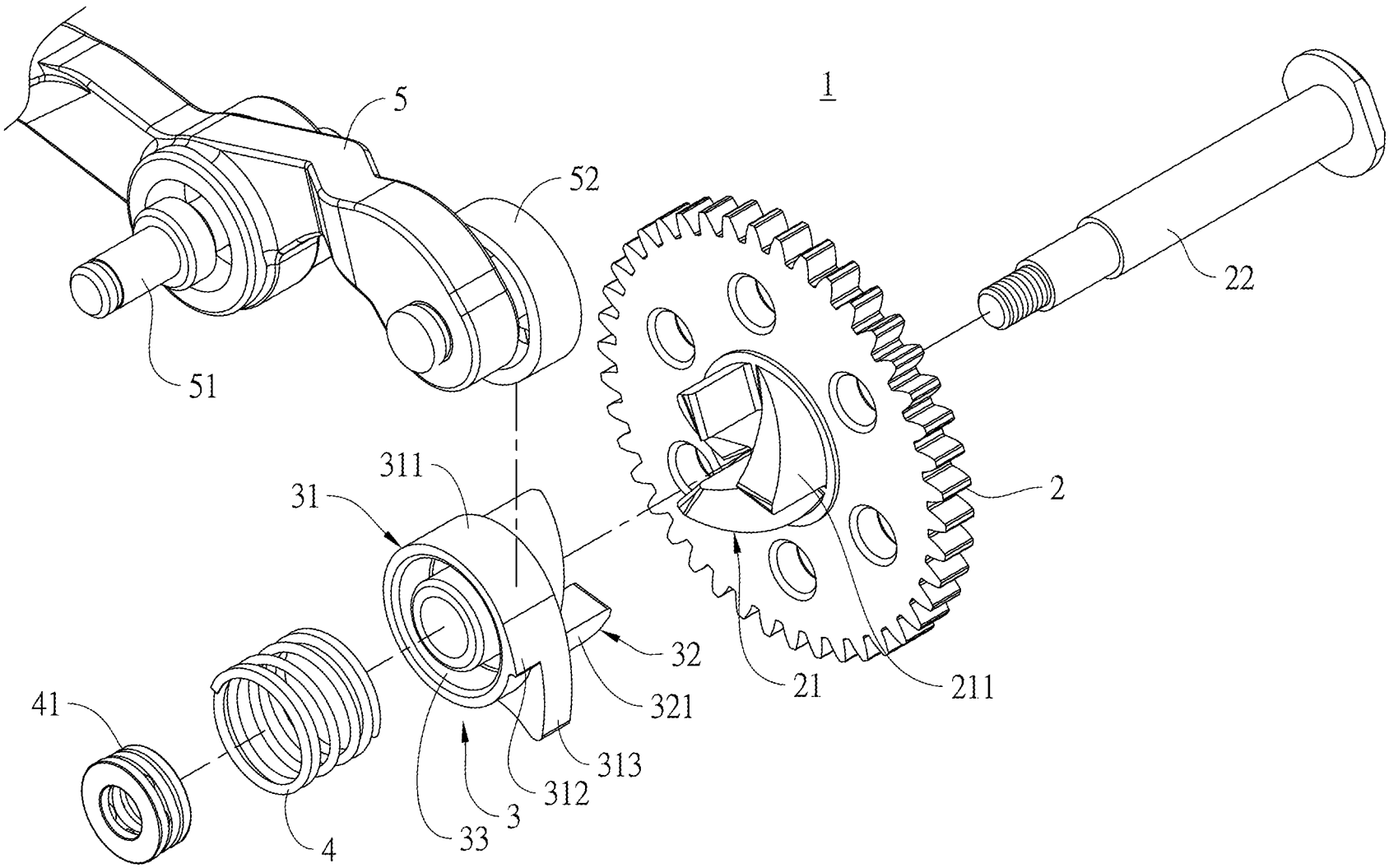
FIG. 1 is an exploded view illustrating a structure for preventing the formation of a dead point for a cam wheel in accordance with a first embodiment of the present invention.
Figure 2:
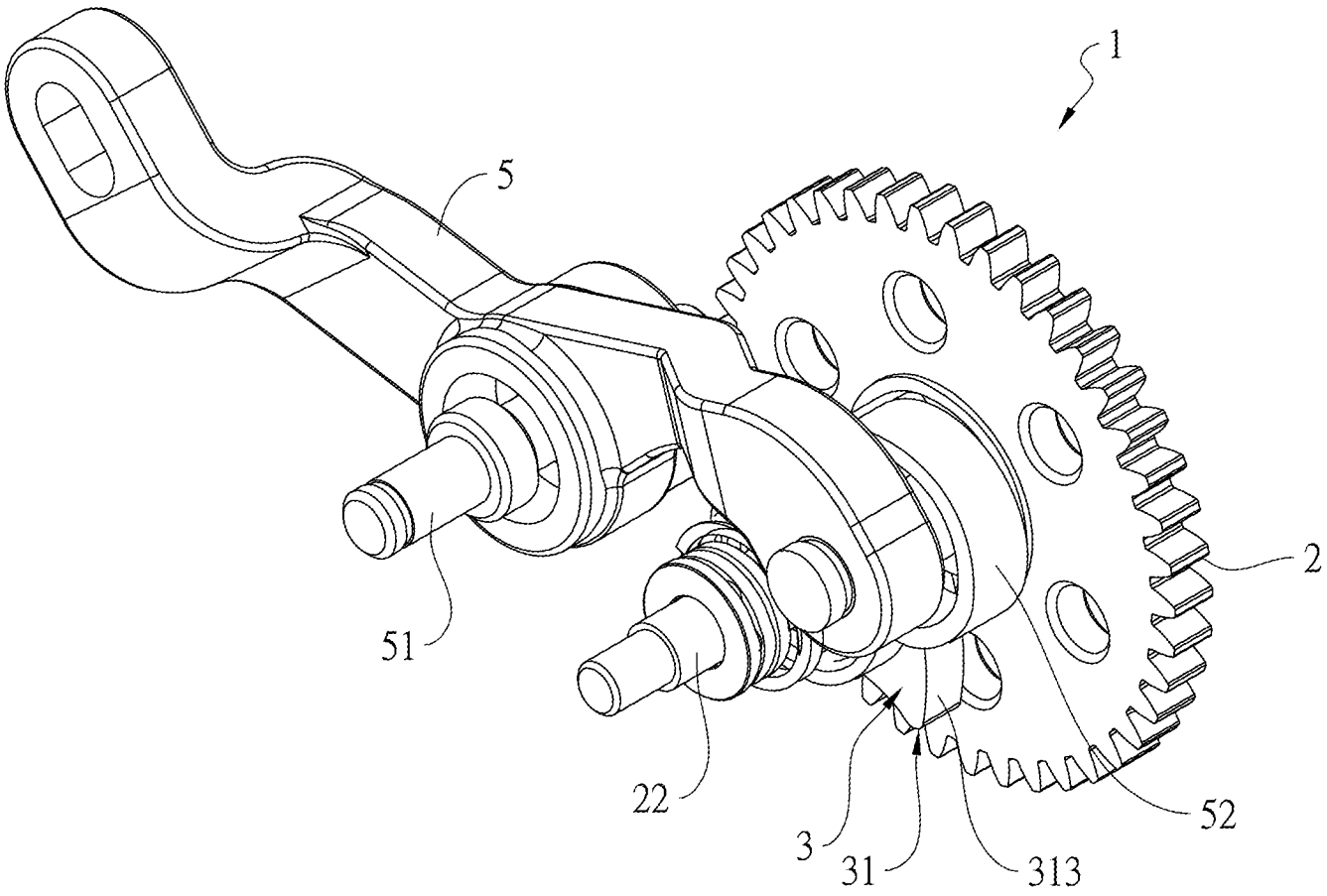
FIG. 2 is a three-dimensional view of the appearance of the structure for preventing the formation of a dead point for a cam wheel in accordance with the first embodiment of the present invention.
Figure 3:
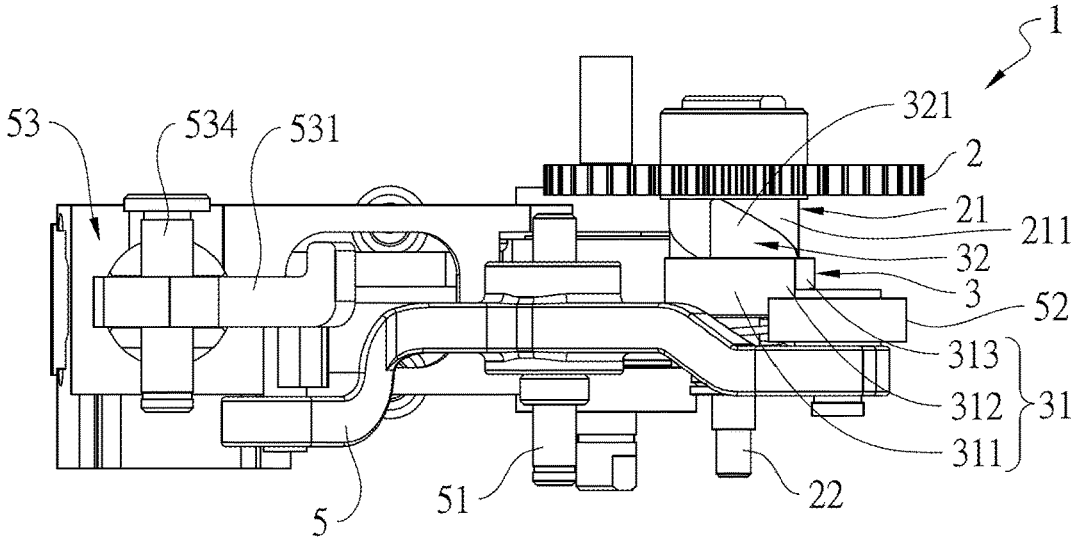
FIG. 3 is a top view illustrating the structure for preventing the formation of a dead point for a cam wheel in accordance with the first embodiment of the present invention.
Figure 4:
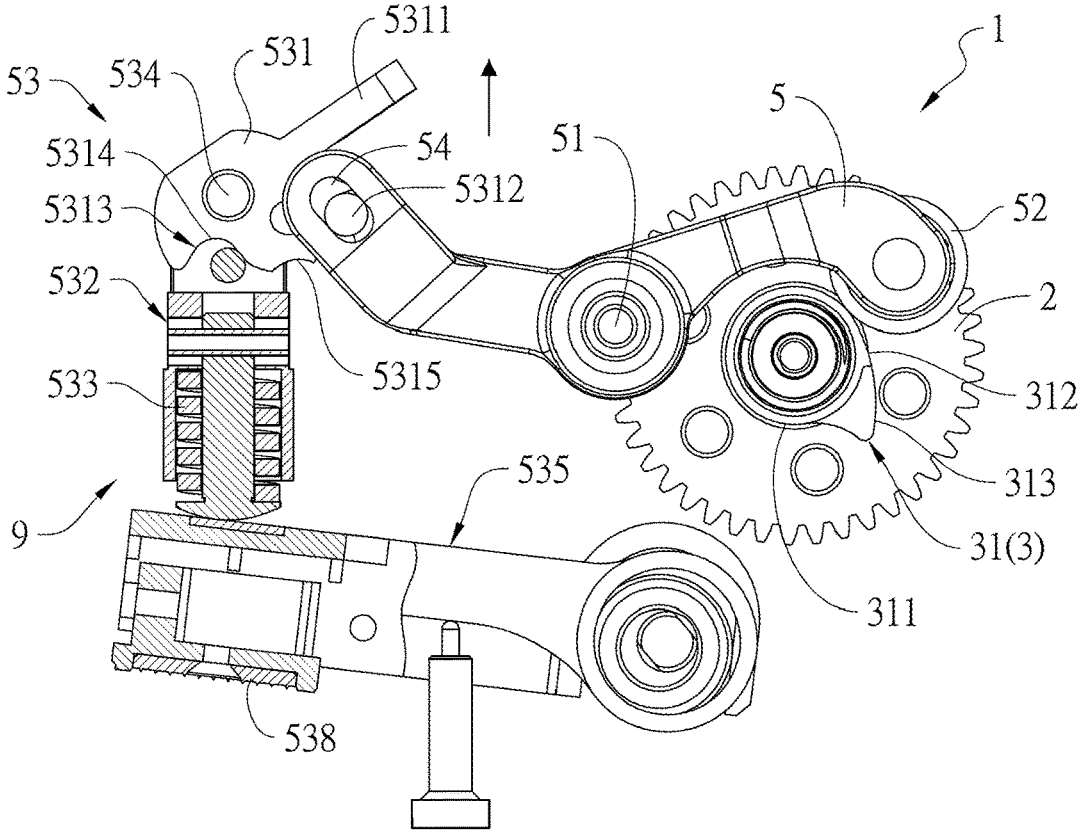
FIG. 4 is a side view illustrating the structure for preventing the formation of a dead point for a cam wheel in accordance with the first embodiment of the present invention.

Referring to FIGS. 1 to 4, a structure for preventing the formation of a dead point for a cam wheel 1 in accordance with a first embodiment of the present invention is illustrated. The structure 1 includes a driving wheel 2, a pressing portion 21, a cam wheel 3, a restoring piece 4, a stopping piece 41 and a swinging piece 5. The driving wheel 2 is a spur gear with a pressing portion 21 provided co-axially at one side of the driving wheel. The pressing portion 21 consists of a plurality of thorn teeth 211 arranged on one side of the driving wheel 2 in a form of circular array. The teeth surfaces of the thorn teeth 211 are all facing a side of the cam wheel 3. The cam wheel 3 is pivoted on the same pivot shaft 22 as the driving wheel 2 in a way of being axially movable with respect to the driving wheel 2.

The cam wheel 3 includes a cam portion 31, a pushed portion 32 and a positioning portion 33 on the same axis. The cam portion 31 includes a circumferential surface 311, a ramp portion 312 and an ascending portion 313. The circumferential surface 311 has an equal radius. The ramp portion 312 extends by way of increasing radius from the axial edge of the circumferential surface 311. The thickness of the ascending portion 313 is less than that of the ramp portion 312, and the ascending portion 313 is formed by continuation from the arc formed by the axial edge of the ramp portion 312. The pushed portion 32 consists of a plurality of thorn teeth 321 arranged in a form of circular array on a side of the cam portion 31. The teeth surfaces of these thorn teeth 321 are all facing the pressing portion 21, such that the pushed portion 32 would engage the pressing portion 21. A circular groove is trenched axially on the other side of the cam portion 31 for receiving and positioning a compression spring. The circular groove serves as the positioning portion 33, while the compression spring acts as the restoring piece 4. The stopping piece 41 is a thrust bearing and axially connected to the pivot shaft 22. The stopping piece 41 is spaced apart from one side of the cam portion 31.

The swinging piece 5 swings around a first axis 51. One end of the swinging piece 5 is provided with a roller follower 52, which is pressed against the circumferential surface 311 of the cam portion 31 by means of a mechanism 53. The mechanism 53 can be a torsion spring, a compression spring or a linkage mechanism. In this embodiment, the swinging piece 5 includes a rocker arm, two ends of which move in opposite directions. The mechanism 53 includes an actuator 531, a pressing piece 532 and an elastic piece 533. The central portion of the actuator 531 intersects a second axis 534, such that it swings around the second axis 534. One end of the actuator 531 is connected with the other end of the pressing piece 532, i.e. the bottom end of the actuator 531 is in contact with the top end of the pressing piece 532 underneath. The pressing piece 532 is sheathed in the elastic piece 533, so that one end of the swinging piece 5 is pressed against the circumferential surface 311 due to the pressing piece 532 exerting an upward force that is transmitted through the actuator 531 and the other end of the swinging piece 5.

Figure 5:
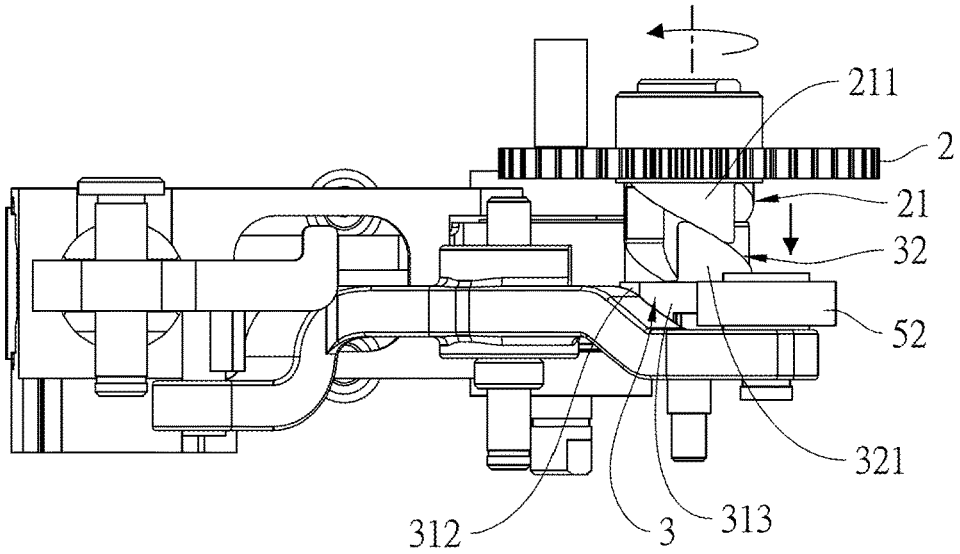
FIGS. 5 to 8 are diagrams illustrating the structure for preventing the formation of a dead point for a cam wheel in accordance with the first embodiment of the present invention in different operation stages.
Figure 6:
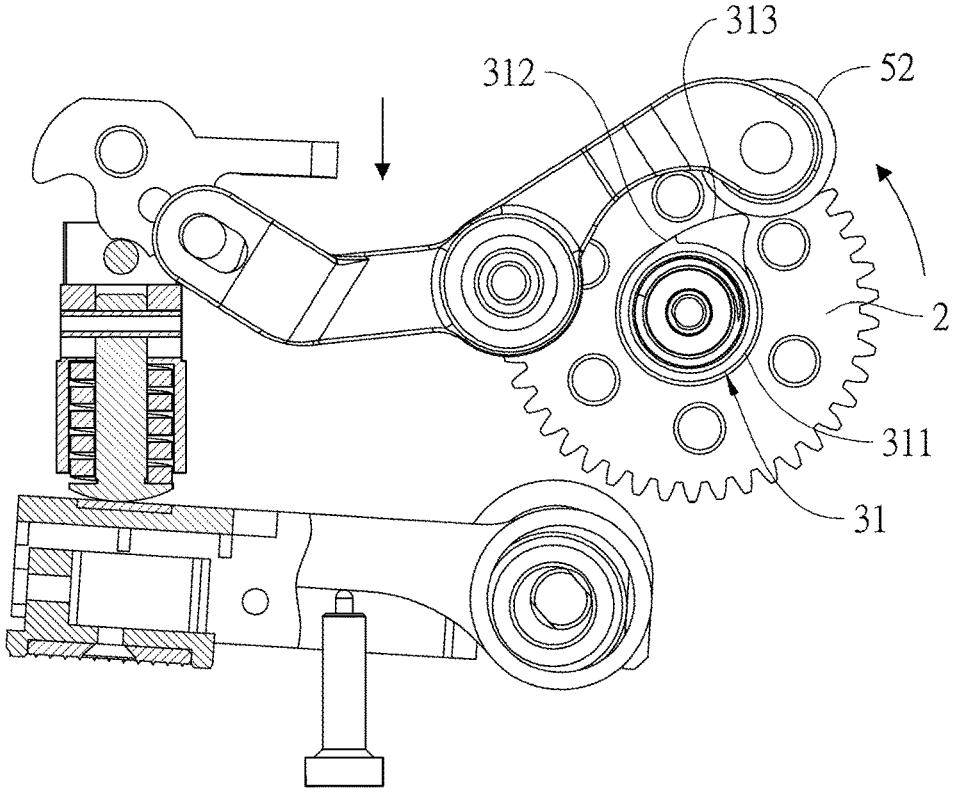

As shown in FIGS. 1, 5 and 6, when the pushed portion 32 of the cam wheel 3 is brought into rotation by the simultaneous turning of the driving wheel 2 and the pressing portion 21, the roller follower 52 at the one end of the swinging piece 5 presses against the circumferential surface 311 of the cam portion 31. As a result of this pressure from the roller follower 52, the cam wheel 3 is unable to rotate smoothly along with the rotation of the driving wheel 2. Owing to the combinations of the thorn teeth (211 and 321) of the pressing portion 21 and the pushed portion 32, the cam wheel 3 rotates while moving in an axial direction away from the one side of the driving wheel 2, wherein the speed of the axial motion is greater than the speed of rotation. Meanwhile, the roller follower 52 at the one end of the swinging piece 5 starts rolling from the circumferential surface 311, and is transitioned smoothly to the ascending portion 313 under the guidance of the ramp portion to be lifted up.

Figure 7:
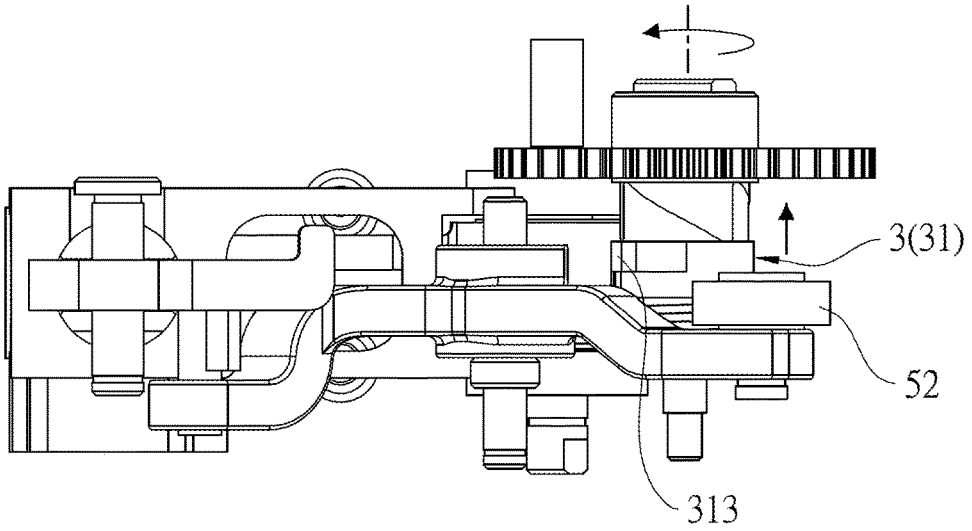
Figure 8:
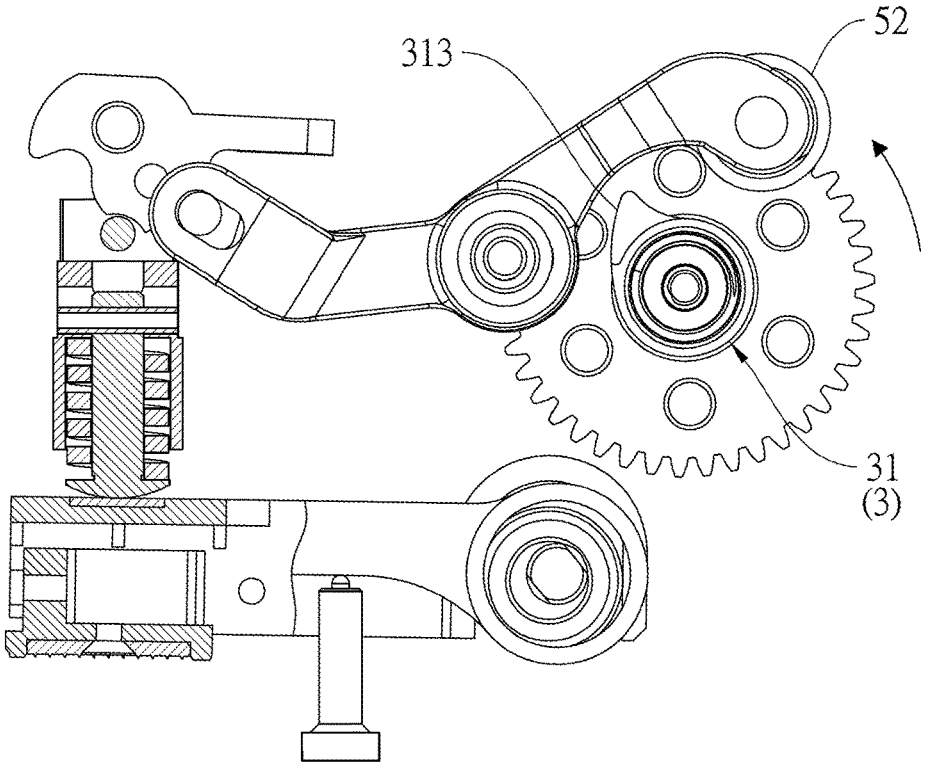

Once the one side of the cam portion 31 touches the stopping piece 41, further axial movements of the cam wheel 3 is prevented by the stopping piece 41. Meanwhile, the restoring piece 4 is compressed, and the roller follower 52 will reach the highest point of the ascending portion 313. If the rotational speed of the cam wheel 3 is fast enough, the roller follower 52 will temporarily move apart from the ascending portion 313 of the cam portion 31, which means that the pressuring force of the roller follower 52 will disappear momentarily. As a result, as shown in FIGS. 1, 7 and 8, the cam wheel 3 can then be pushed back to its original position by means of elasticity of the restoring piece 4. At this point, the ascending portion 313 of the cam portion 31 and the roller follower 52 would have already been displaced in space, avoiding the formation of a dead point.

Figure 9:
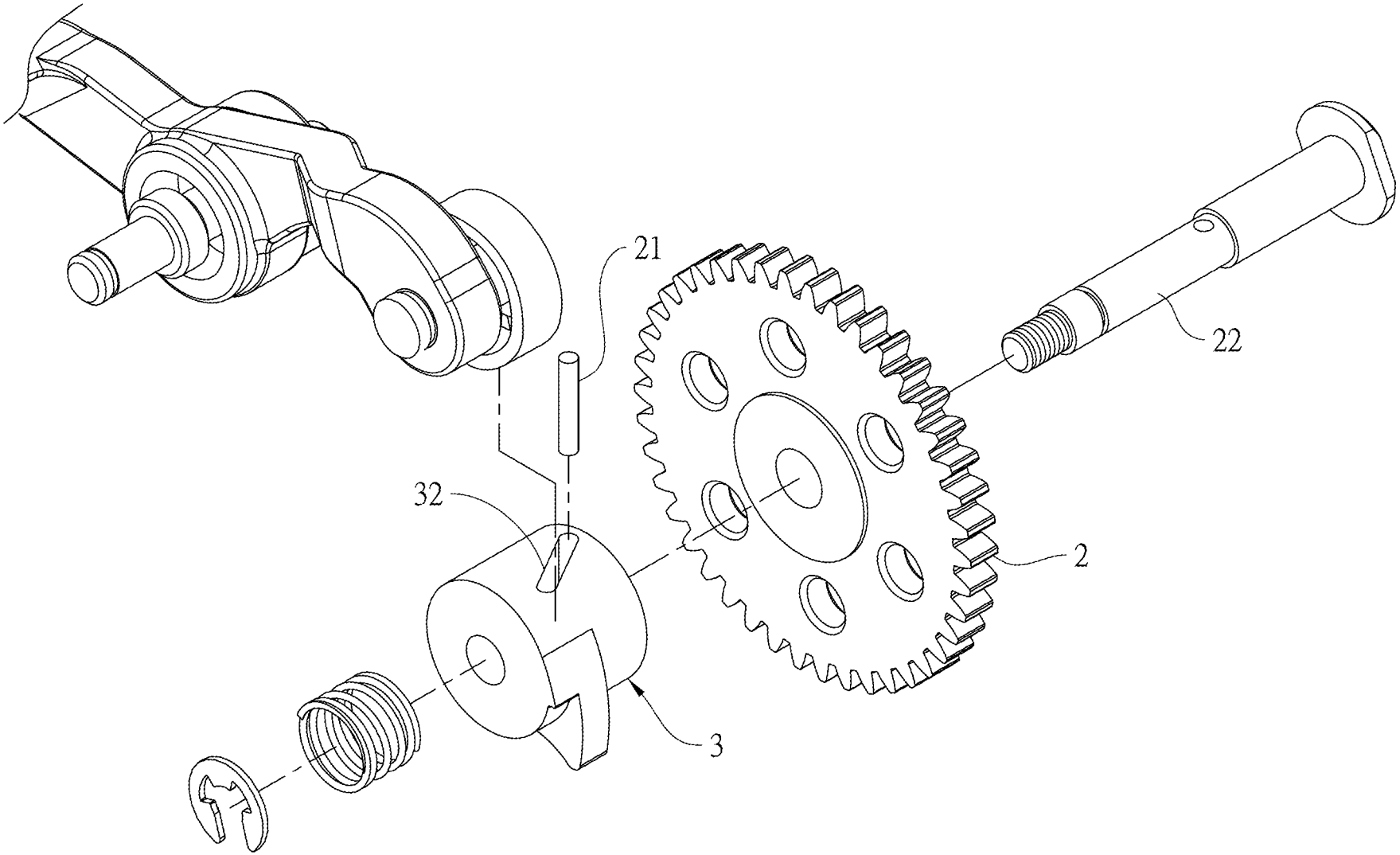
FIG. 9 is an exploded view illustrating a structure for preventing the formation of a dead point for a cam wheel in accordance with a second embodiment of the present invention.

Referring to FIG. 9, a structure for preventing the formation of a dead point for a cam wheel 1 in accordance with a second embodiment of the present invention is illustrated. This embodiment is different from the first embodiment in that the pressing portion 21 is in the form of a rod, which is radially provided on the outer periphery of the pivot shaft 22, while the pushed portion 32 is a guiding slot extending spirally along the circumferential surface of the cam wheel 3 and arranged radially to allow pressing portion 21 to be inserted and limited therein. Therefore, this similarly allows the cam wheel 3 to move axially in a direction away from the driving wheel 2 when the driving wheel 2 rotates.

Figure 10:
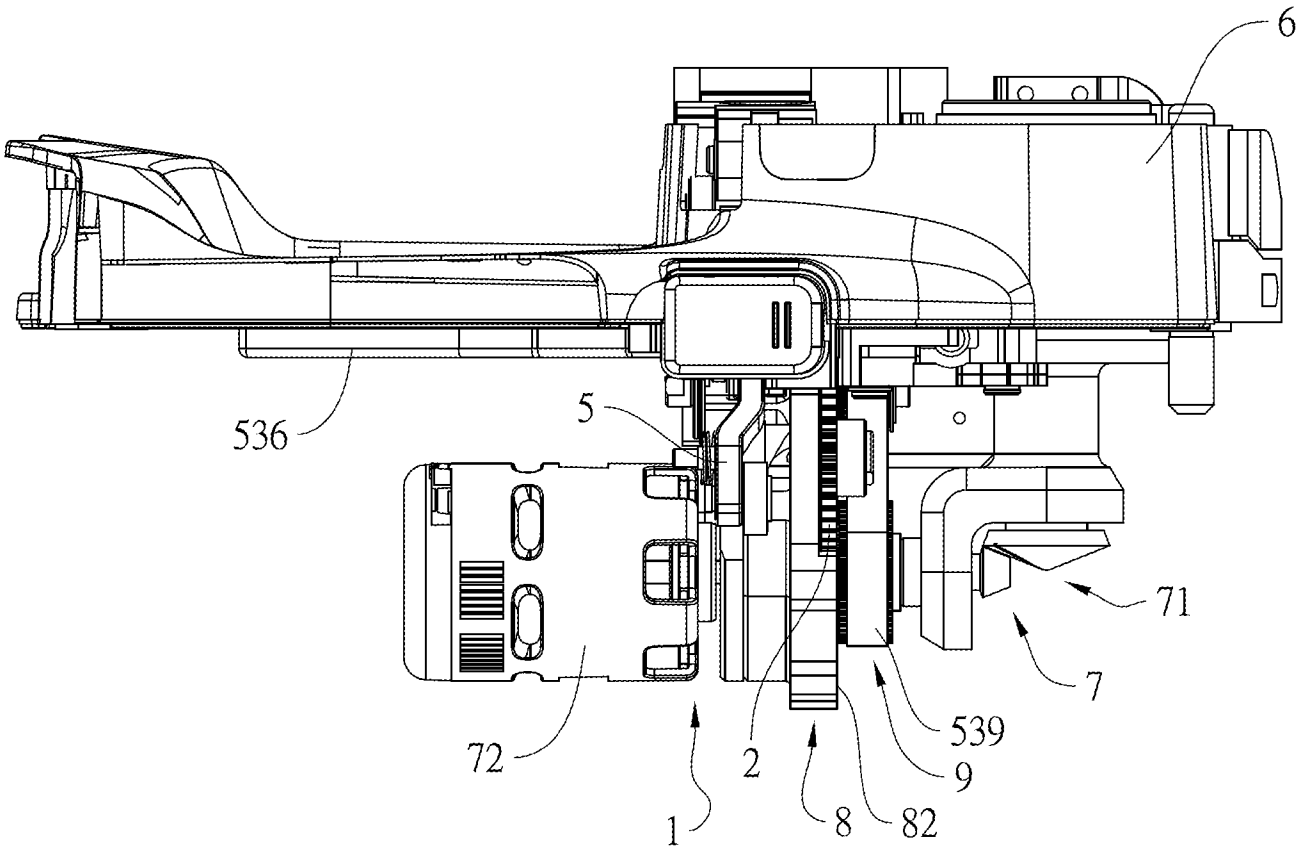
FIGS. 10~12 are three-dimensional views illustrating the appearance of a strapping device in accordance with the present invention.
Figure 11:
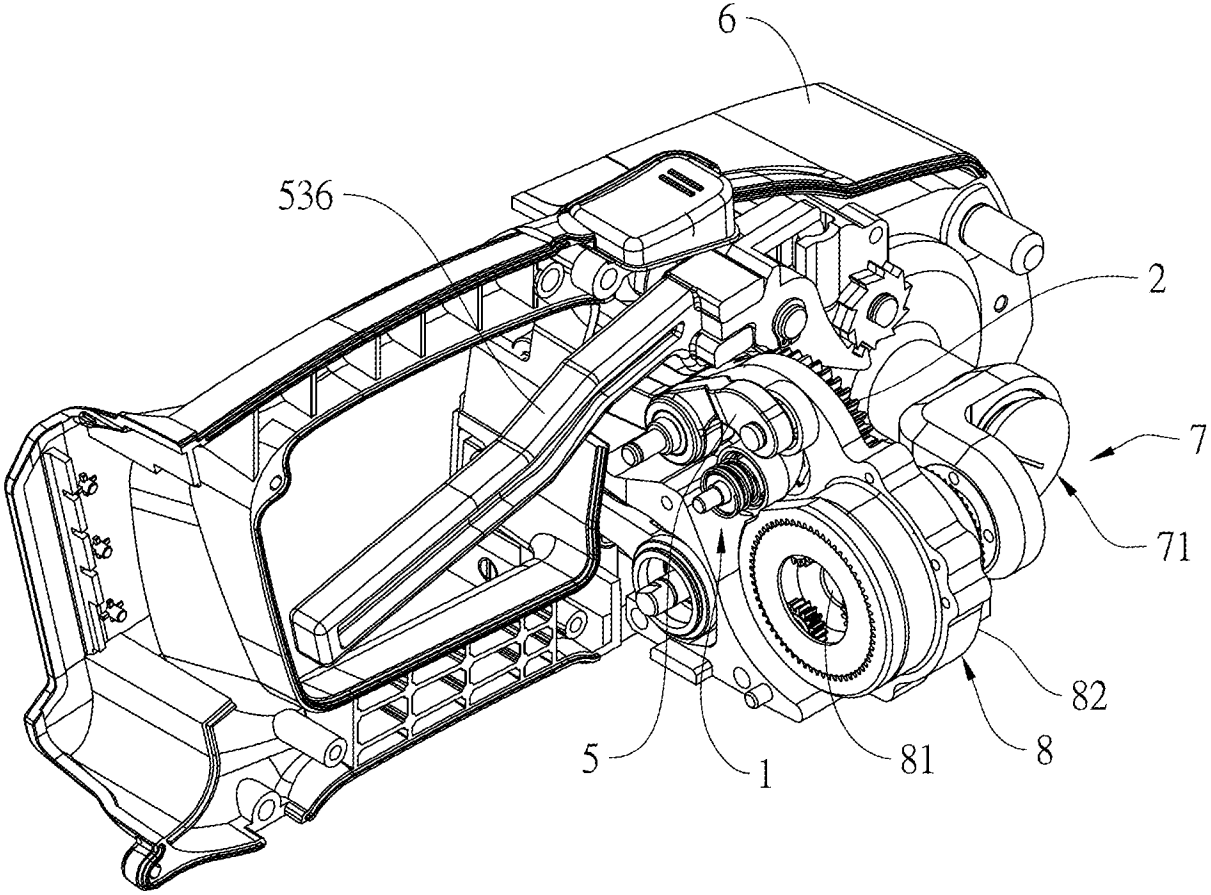
Figure 12:
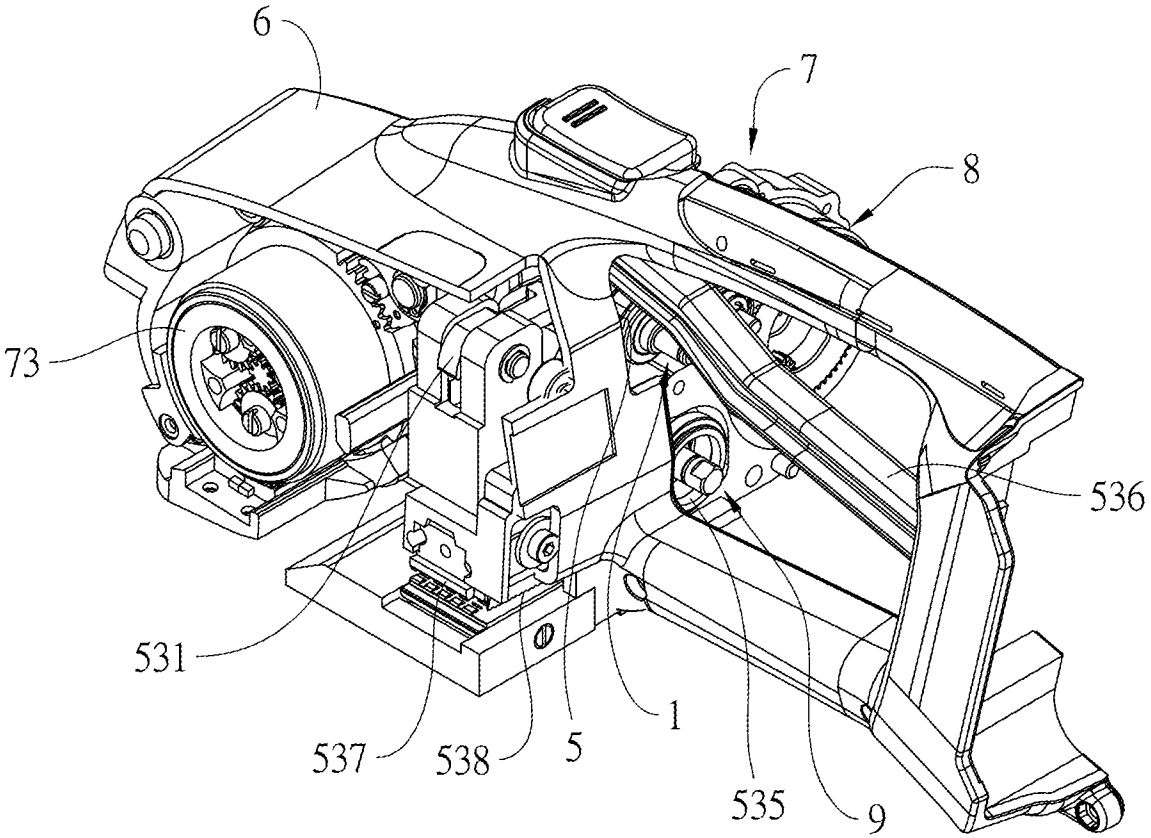

Referring to FIGS. 10-12, a strapping device in accordance with a preferred embodiment of the present invention is shown, which includes the structure for preventing the formation of a dead point for a cam wheel 1 as described above, a housing 6, a first transmission assembly 7, a second transmission assembly 8 and a third transmission assembly 9, wherein a cavity is formed in the housing 6 in which the first transmission assembly 7, the second transmission assembly 8 and the third transmission assembly 9 are received.

The first transmission assembly 7 essentially includes a first anti-reverse bearing and a first gear set 71. The first anti-reverse bearing is connected to a motor serving as an electric drive 72. The first gear set 71 is connected to a feeder wheel 73, which rotates along with the rotation of the first gear set 71 powered by the electric drive 72 in order to tension a strap. The second transmission assembly 8 essentially includes a second anti-reverse bearing 81 and a second gear set 82. The second anti-reverse bearing 81 is located on the same axis as the first anti-reversing bearing but rotates in the opposite direction. The second gear set 82 is connected to the driving wheel 2. After the strap is tensioned by the feeder wheel 73, the driving wheel 2 is actuated by the electric drive 72 to rotate in the opposite direction to push up the one end of the swinging piece 5.

As shown in FIGS. 4, 10~12, the third transmission assembly 9 essentially includes the actuator 531, the pressing piece 532, the elastic piece 533 and a crankshaft-connection-rod set 535. The central portion of the actuator 531 intersects the second axis 534, and one end of the actuator 531 includes a protruding bar 5311 and a linking rod 5312. The protruding bar 5311 is connected to a handle 536, while the linking rod 5312 is passed through an elongated slot 54 at the other end of the swinging piece 5, so it is movably connected with the other end of the swinging piece 5. A positioning portion 5313 provided at the bottom end of the actuator 531 includes a first arched recess 5314 and a second arched recess 5315 that come into contact with the underlying top end of the pressing piece 532 that is sheathed in the elastic piece 533. The bottom end of the pressing piece 532 is provided with a sealing head 537 and a cutter 538 that are connected to the crankshaft-connection-rod set 535. The crankshaft-connection-rod set 535 is further connected to the second anti-reverse bearing 81 via a transmission belt 539, such that when the second anti-reverse bearing 81 is turning and the pressing piece 532 is pressing downwards, the overlapped area of the strap can be sealed together due to the quick oscillating back and fro movements performed by the sealing head 537. Then, the excess portion of the strap is cut off. At this time, the contact in which the top end of the pressing piece 532 is in with the actuator 531 is shifted from the first arched recess 5314 to the second arched recess 5315. The pressing piece 532 stays in contact with the second arched recess 5315 until the handle 536 is lifted up manually after sealing and cutting are completed. Lifting of the handle 536 raises the actuator 531 via the protruding bar 5311, which returns the first arched recess 5314 to be in contact with the top end of the pressing piece 532 again while allowing the one end of the swinging piece 5 to decline back to its prior position in order to be ready for the next strapping procedure.

In summary, from what have been described above, the present invention provides a solution to overcome the phenomenon of "dead points" as seen in conventional designs where one end of a swinging piece, when being lowered, may come into contact with and become obstructed by a raised portion of a cam wheel and further movements are prevented. The work efficiency is improved by the present invention, and a patent application is hereby filed in accordance with the law.

What is claimed is:

1. A structure of a strapping device for preventing the formation of a dead point for a cam wheel, comprising:

a driving wheel, provided with a pressing portion arranged to be coaxial with the driving wheel at one side thereof;

a cam wheel, pivoted on the driving wheel in a way of being axially movable with respect to the driving wheel, the cam wheel including a cam portion and a pushed portion around the same axis, the pushed portion in contact with the pressing portion, the pushed portion being pushed by the pressing portion when the driving wheel rotates, such that the cam wheel is moved axially in a direction away from one side of the driving wheel;

a swinging piece, with one end abutting against the outer periphery of the cam wheel by force from a mechanism, such that the one end of the swinging piece is pushed by the cam portion when the cam wheel axially moves and rotates; and a restoring piece, connected with the cam wheel for axially pushing the cam wheel back to its original position when the one end of the swinging piece is moved to be apart from the outer periphery of the cam wheel.

2. The structure for preventing the formation of a dead point for a cam wheel of claim 1, wherein the pressing portion includes a plurality of thorn teeth arranged in a form of circular array on the one side of the driving wheel with their teeth surfaces facing the cam wheel, and the pushed portion is a plurality of thorn teeth with their teeth surfaces facing and engaging the pressing portion.

3. The structure for preventing the formation of a dead point for a cam wheel of claim 1, wherein the pressing portion is a rod, and the pushed portion is a guiding slot formed on the cam wheel and arranged radially for the rod to be inserted and limited therein.

4. The structure for preventing the formation of a dead point for a cam wheel of claim 1, wherein the cam wheel includes:

a circumferential surface, having an equal radius;

an ascending portion, having a thickness less than that of the circumferential surface for pushing the one end of the swinging piece; and a ramp portion, having gradually increasing radii for guiding the one end of the swinging piece from the circumferential surface onto the ascending portion of the cam wheel.

5. The structure for preventing the formation of a dead point for a cam wheel of claim 1, wherein the restoring piece is a compression spring, and one end of the cam portion is provided with a positioning portion for positioning the compression spring.

6. The structure for preventing the formation of a dead point for a cam wheel of claim 1, further comprising a stopping piece pivoted on the driving wheel and the cam wheel for stopping the cam wheel so as to limit the axial movements of the cam wheel.

7. A strapping device comprising:

the structure for preventing the formation of a dead point for a cam wheel of claim 1;

a housing;

a first transmission assembly, received in the housing, the first transmission assembly connected to a feeder wheel, the first transmission assembly driven by an electric drive to rotate the feeder wheel to tension a circular strap;

a second transmission assembly, connected with the driving wheel, the second transmission assembly driven by the electric drive to rotate the driving wheel to push the one end of the swinging piece; and a third transmission assembly, including a pressing piece, a crankshaft-connection-rod set and an actuator, the pressing piece sheathed inside an elastic piece, a sealing head and a cutter being provided at the bottom of the pressing piece and connected with the crankshaft-connection-rod set, such that the crankshaft-connection-rod set is driven by the electric drive to reciprocate the sealing head laterally to perform rapid friction bonding of the overlapping portion of the circular strap, and the excess portion of the circular strap is cut off by the cutter, the swinging piece being a rocker arm, two ends of which swing in opposite directions, and the actuator being connected to the one end of the rocker arm and provided with a positioning portion for positioning one end of the pressing piece.

8. A strapping device comprising:

the structure for preventing the formation of a dead point for a cam wheel of claim 4;

a housing;

a first transmission assembly, received in the housing, the first transmission assembly connected to a feeder wheel, the first transmission assembly driven by an electric drive to rotate the feeder wheel to tension a circular strap;

a second transmission assembly, connected with the driving wheel, the second transmission assembly driven by the electric drive to rotate the driving wheel to push the one end of the swinging piece; and a third transmission assembly, including a pressing piece, a crankshaft-connection-rod set and an actuator, the pressing piece sheathed inside an elastic piece, a sealing head and a cutter being provided at the bottom of the pressing piece and connected with the crankshaft-connection-rod set, such that the crankshaft-connection-rod set is driven by the electric drive to reciprocate the sealing head laterally to perform rapid friction bonding of the overlapping portion of the circular strap, and the excess portion of the circular strap is cut off by the cutter, the swinging piece being a rocker arm, two ends of which swing in opposite directions, and the actuator being connected to the one end of the rocker arm and provided with a positioning portion for positioning one end of the pressing piece.

* * * * *